United States Patent [19]

Streubel et al.

[11] Patent Number: 4,485,836

[45] Date of Patent: Dec. 4, 1984

[54] STRAND GUIDE ROLLS MOUNTED COAXIALLY AND NEIGHBOURING ONE ANOTHER IN A CONTINUOUS CASTING INSTALLATION FOR CASTING STEEL SLABS

[75] Inventors: Hans Streubel, Erkrath; Hans-Otto Thörner, Meerbusch, both of Fed. Rep. of Germany

[73] Assignee: SMS Schloemann-Siemag AG, Düsseldorf, Fed. Rep. of Germany

[21] Appl. No.: 249,015

[22] Filed: Mar. 30, 1981

[30] Foreign Application Priority Data

Apr. 8, 1980 [DE] Fed. Rep. of Germany ..... 3013484

[51] Int. Cl.[3] ..... B22D 11/00; B22D 11/128

[52] U.S. Cl. ..... 164/442; 164/448

[58] Field of Search ..... 164/442, 448, 484; 29/124, 125

[56] References Cited

U.S. PATENT DOCUMENTS

| | | | |
|---|---|---|---|
| 3,347,308 | 10/1967 | Saunders | 164/442 |
| 3,981,348 | 9/1976 | Schmucker | 164/448 |
| 4,071,073 | 1/1978 | Bollig | 164/448 |
| 4,076,341 | 2/1978 | Scheurecker | 164/448 |
| 4,137,963 | 2/1979 | Langner | 164/442 |
| 4,222,433 | 9/1980 | Marti | 164/448 |
| 4,227,636 | 10/1980 | Rahmfeld | 164/448 |

*Primary Examiner*—Kuang Y. Lin
*Assistant Examiner*—Richard K. Seidel
*Attorney, Agent, or Firm*—Werner W. Kleeman

[57] ABSTRACT

An arrangement of coaxial neighbouring, mutually independently mounted strand guide rolls for use in a continuous casting installation for casting steel slabs is disclosed. At the region of the path of travel of the cast slab mutually neighbouring bearing or roll journals of two cooled strand guide rolls are interconnected by a coupling means which can be mounted upon the bearing or roll journals. The coupling means is provided with entrainment surfaces for the rotational movement of the guide rolls. These entrainment surfaces coact with the bearing or roll journals.

11 Claims, 7 Drawing Figures

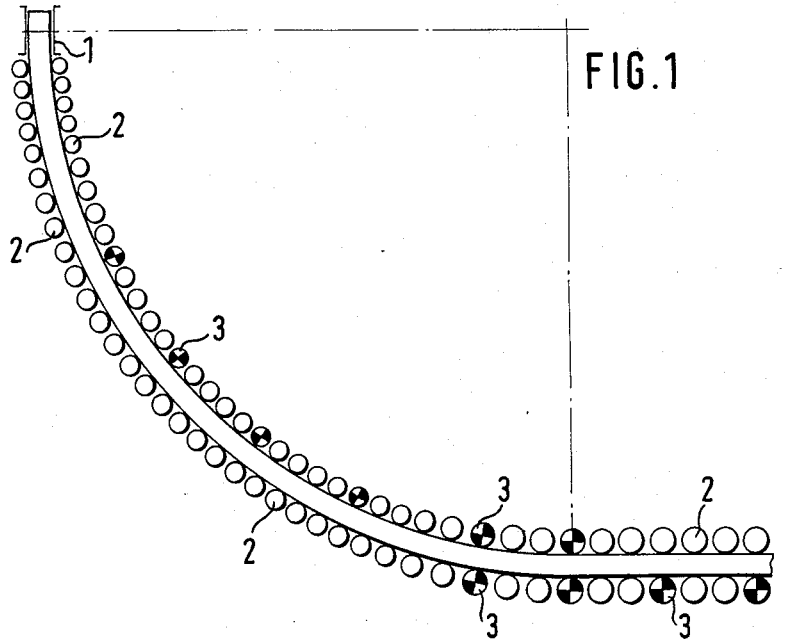
FIG.1
FIG.2
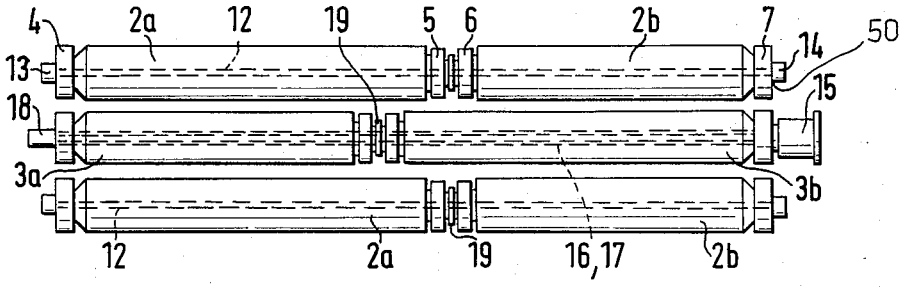
FIG.3
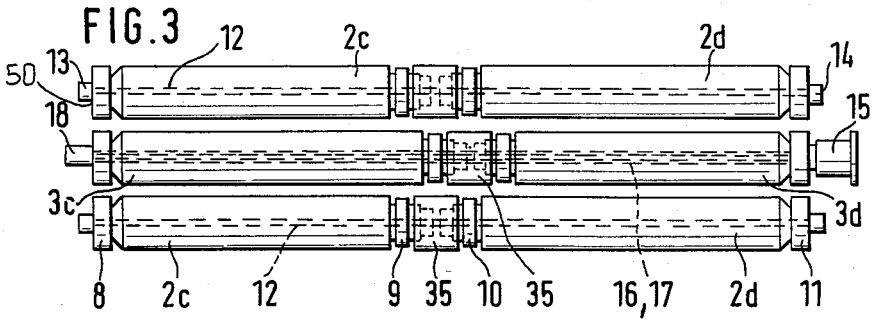

STRAND GUIDE ROLLS MOUNTED COAXIALLY AND NEIGHBOURING ONE ANOTHER IN A CONTINUOUS CASTING INSTALLATION FOR CASTING STEEL SLABS

BACKGROUND OF THE INVENTION

The present invention relates to a new and improved arrangement of strand guide rolls mounted coaxially and neighbouring one another in a continuous casting installation for casting steel slabs.

The guide rolls of continuous casting installations are subjected, during each revolution of the rolls, to a high mechanical alternating load by virtue of the ferrostatic pressure which is effective at the strand shell or skin. This high mechanical alternating load can exceed 100 tons per roll in the case of slab casting installations. An additional loading of the rolls occurs because of the shock-like temperature increase of the roll surface during each contact of the rolls with the hot strand. Depending upon the strength of the roll material these mechanical and thermal loads require a predetermined roll diameter.

The momentarily employed roll diameter requires a certain minimum spacing between the rolls, and thus, determines the size of the unsupported surface between successive rolls. The mutual dependency between the permissable roll loading, the strand width, the strand shell or skin thickness, the ferrostatic pressure, the roll diameter and the spacing between successive rolls, when casting large sectional shapes or formats, limits the casting speed, since deleterious bowing-out and metal break-out must be avoided. Strands having a width of, for instance, in excess of 2 meters and at least 150 mm thickness require either expensive roller apron frameworks or in the case of vertical or curved or arc-type roller aprons can only be cast with relatively short liquid core and only with relatively low casting speeds.

In order to render possible casting of strands of greater width at increased casting speeds, it is already known in this technology to use, in place of continuous guide rolls, multiply supported guide rolls. A prior art strand guide roll consists of a number of roll sections, whose roll journals at one side are threaded into recesses of the neighbouring roll section, and between the roll sections there is provided in each case a support bearing. Extending through the roll sections is a cooling channel. Significant in this regard is German Pat. No. 2,420,514, published July 10, 1975. With this constructionally complicated strand guide roll the assembly and the exchange of the rolls is cumbersome and time-consuming. Since tthe connection journals are exposed to intensive bending loads the roll sections can not be appreciably extended in length in order to reduce the bearing locations. A further drawback of such guide roll is that at the connection locations between the rolls and journals there is hindered heat transfer, so that there is not ensured for uniform cooling throughout the roll length.

Also in British Pat. No. 1,565,845, published Apr. 23, 1980, there is disclosed a roller apron or strand guide arrangement, wherein over the strand width there are coaxially mounted in each case two guide rolls. With this economically favorable construction it is possible to assemble and dismantle the guide rolls more quickly. However, what is disadvantageous with this design is that in the case of a strand which bears at one side only at one roll the coaxially neighbouring other roll remains stationary and because of the one-sided overheating by the strand is extensively thermally loaded. Consequently, at this region there is promoted the formation of heat cracks and notwithstanding cooling the roll is bent-through in the direction of the strand. With renewed contact with the strand the bearings are markedly loaded. The untrue running of the guide rolls can lead to an irregular supporting of the strand, and thus, to strand defects or flaws. Moreover, the cooling system between two neighbouring rolls is complicated.

Further constructions of roller aprons and guide rolls used in continuous casting installations are exemplified by U.S. Pat. No. 4,071,073, granted Jan. 31, 1978 and U.S. Pat. No. 4,222,433, granted Sept. 16, 1980.

SUMMARY OF THE INVENTION

Therefore, with the foregoing in mind it is a primary object of the present invention to avoid the drawbacks of the heretofore known aprons or strand guide arrangements.

Another and more specific object of the present invention aims at providing a constructionally simple, maintenance-friendly and cost-favorable roller apron or strand guide arrangement containing coaxial neighbouring, mutually independently mounted guide rolls, wherein an irregular or nonuniform thermal loading of the cooled guide rolls is avoided and there is ensured for a uniform, good strand supporting action, without excessive roll and bearing loads resulting in pronounced wear.

Still a further significant object of the present invention aims at prolonging the service life of such rolls along with their bearings.

Now in order to implement these and still further objects of the invention, which will become more readily apparent as the description proceeds, the present development is manifested by the features that at the region of the path of travel of a slab casting the mutually neighbouring bearing or roll journals of two cooled strand guide rolls are interconnected by a coupling means which can be mounted upon the bearing or roll journals. This coupling means is provided with entrainment surfaces for the rotational movement of the rolls. These entrainment surfaces cooperate with the bearing journals.

By virtue of this construction there is ensured that the coaxial neighbouring, mutually independently mounted strand guide rolls can continuously rotate independent of one-sided strand contact and no longer are overheated by the strand at one side. In this way it is possible to prolong the longevity of the guide rolls and bearings and to provide uniform supporting of the strand.

The coupling means may be in the form of a ring with a tooth configuration of similar or equivalent structure in the cavity of the ring, coacting with a related configuration at the journals.

According to a further feature of the invention the coupling means may be in the form of a coupling disk for receiving flat structured entrainment members or entrainment means of the guide rolls. The coupling disk is then provided with a slot at both sides or faces thereof in the manner of an Oldham coupling. These slots extend perpendicularly to one another, i.e. constitute diametrical slots. The external diameter of the coupling disk is equal to or greater than the diameter of the roll or bearing journals. This coupling also renders possible compensation of greater axial deviations of the neighbouring guide rolls.

The support of the cast strand, according to a further feature of the invention, can be additionally improved in that the coupling means possesses the same external or outer diameter as the related coaxially neighbouring guide rolls. In this manner the unsupported region of the strand, governed by the neighbouringly arranged roll bearings, is reduced to the width of the housing of a roll bearing.

There can be arranged at the neighbouring bearing journals of the guide rolls alternative square or four-cornered journals, with which there is operatively associated at each side of the coupling disk an appropriately configured recess or the like.

The four-cornered or square journals can advantageously be provided with domed or arched side surfaces, in order to reduce the surface compression during radial movements or shifting of the rolls.

A simplification of the cooling agent-guide arrangement in the roll interior can be attained in that the coupling means and/or the neighbouring roll journals contain devices or means for connecting the cooling agent guides from one roll to the neighbouring roll. In this way there is attained the possibility with counterflow of the cooling agent, to arrange the connections for both rolls in a space-saving manner at the outer journal of a guide roll. However, the cooling agent also can be permitted to flow in one direction through both of the rolls, when the outer journal of one roll is provided with an inflow means and the outer journal of the other roll with an outflow means.

To obtain a good internal cooling the cooling agent channel is widened into a ring-shaped or annular groove at the region of the coupling means.

The strand support finally can be additionally improved in that the bearings of guide rolls which follow one another in the direction of strand travel are offset with respect to one another in the axial direction.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 schematically illustrates in side view a continuous casting installation for strands;

FIG. 2 illustrates a portion of the roller apron or strand guide arrangement composed of a number of coaxial neighbouring mounted guide rolls;

FIG. 3 illustrates a different portion of the roller apron composed of a number of coaxial neighbouring mounted guide rolls;

DETAILED DESCRIPTION OF THE PREFERRED EMBODIMENTS

Figure 4:
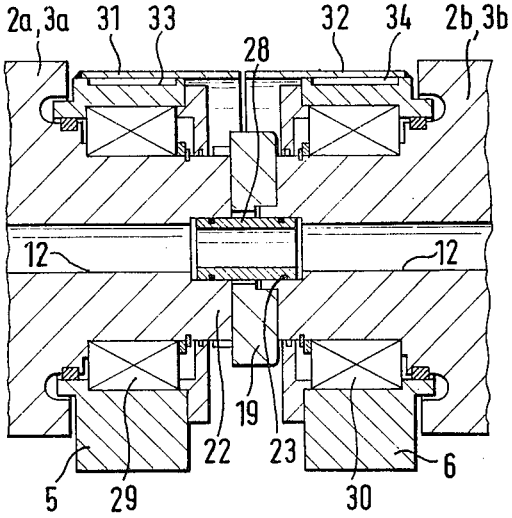
FIG. 4 is a fragmentary sectional view of two neighbouring mounted guide rolls containing an intermediately arranged coupling disk according to FIG. 2.

Describing now the drawings, it is to be understood that only enough of the construction of the continous casting plant or installation has been shown in the drawings in order to simplify the same, while still enabling one skilled in the art to readily understand the underlying principles and concepts of the present development. In the exemplary embodiment of continuous casting installation shown in FIG. 1 a curved or arc-type roller apron or strand guide arrangement is located after a continuous casting mold 1, this roller apron or strand guide arrangement containing successively arranged guide rolls 2 and 3. The guide rolls 3 constitute driven rolls as symbolically illustrated in FIG. 1.

FIGS. 2 and 3 show portions of two alternative constructions of the roller apron or strand guide arrangement. In both embodiments there are mounted independent of one another and so as to be coaxially neighbouring one another, in each case, two strand guide rolls or rollers *2a, 2b, 3a, 3b* and *2c, 2d, 3c, 3d* in two respective bearings 4, 5 and 6, 7 and 8, 9 and 10, 11. The guide rolls *2a* and *2b* and *2c* and *2d* are provided with a respective internal channel 12 for the throughflow of a suitable cooling agent, typically water, wherein there are arranged at the outer bearing or roll journals, merely generally indicated by reference character 50 in FIGS. 2 and 3, of the mentioned rolls any suitable rotary transmissions 13, 14. The driven strand guide rolls *3b* and *3d* are provided with a suitable drive means, here for instance shown as a drive flange 15. The internal cooling of the coaxially mounted guide rolls *3a, 3b* and *3c, 3d* is accomplished according to the reverse flow principle in two concentrically arranged channels 16, 17, and the infeed and withdrawal of the cooling agent or coolant is accomplished by a double rotary transmission or rotary throughpass arrangement 18 provided at the outer journals of the guide rolls *3a* and *3c*. Both in the construction of FIG. 2 and also in accordance with that of FIG. 3 the neighbouring bearings 5, 6 and 9, 10, respectively, of successive guide rolls are offset in axial direction in order to improve the supporting of the continuously cast strand.

Figure 5:
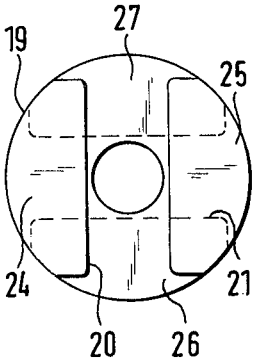
FIG. 5 is a front view of the coupling disk shown in FIG. 4.

According to the showing of FIG. 2 there is arranged between the guide rolls *2a, 2b* and *3a, 3b* a respective coupling means, here shown as a coupling disk 19. This region has been shown on an enlarged scale in FIGS. 4 and 5. The connection of the guide rolls *2a* and *2b* as well as *3a* and *3b* is accomplished in accordance with the principle of a conventional Oldham coupling, rendering possible compensating any axial deviations of the rolls. To this end, the coupling disk 19 or equivalent structure, shown in FIG. 5, is provided at both sides or faces with a respective slot 20 and 21 which extend diametrically with respect to one another, i.e. at right angles to one another. At the bearing or roll journals of the guide rolls *2a, 2b, 3a, 3b* there are arranged substantially flat constructed entrainment members or entrainment means 22 and 23, respectively, which can be fittingly inserted into the slots 20, 21 of the coupling disk 19. The diameter of the coupling disk 19 is greater than the greatest height of the entrainment members 22 and 23. In this way it is possible to ensure for sufficiently strong power transmission cross-sectional regions or portions 24, 25 and 26, 27.

The cooling agent channel 12 of the guide rolls *2a* and *2b, 3a* and *3b* are interconnected by a tubular section or piece 28 which is sealingly inserted into the roll journals.

In order to support the rollers bearings 29, 30 the bearing means or bearings 5, 6 at the side of the strand are provided with a respective cooling jacket or shell 33, 34 formed by the sheet metal elements 31, 32. These sheet metal elements 31 and 32 or equivalent structure are guided over the coupling disk 19 for screening the same.

Figure 7:
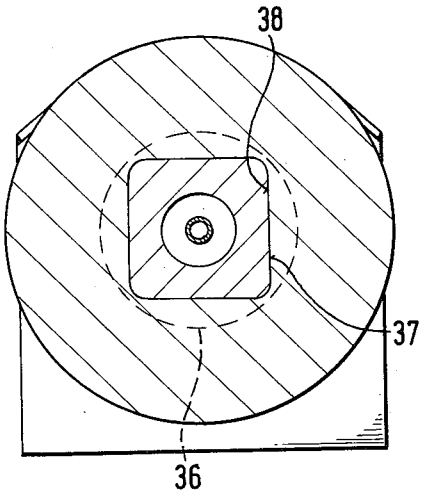
FIG. 7 is a cross-sectional view of the arrangement of FIG. 6, taken along the therein indicated sectional line.
Figure 6:
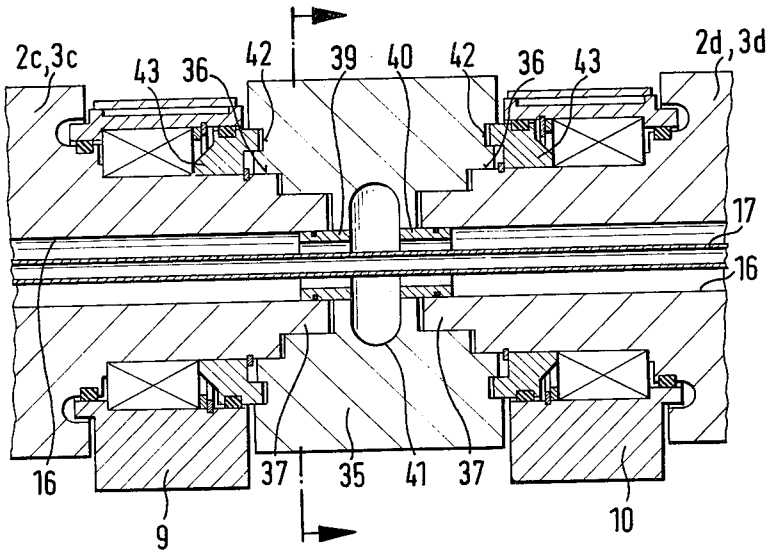
FIG. 6 is a fragmentary sectional view of two neighbouring mounted guide rolls having an intermediately arranged coupling disk according to FIG. 3.

With the embodiment of FIG. 3 there is arranged a respective coupling disk 35 between the bearings 9 and 10 of the guide rolls *2c, 2d* and *3c, 3d,* respectively. This design has been illustrated on an enlarged sectional view in FIGS. 6 and 7. It will be seen that the coupling disk 35 is provided at both sides with bores 36 for centering the same upon the roll or bearing journals of the rolls *2c, 2d, 3c, 3d.* For transmitting the torque or rotational moment the journals are provided with a respective square or four-cornered portion 37, which fittingly engages into a respective appropriately configured recess 38 or the like of the coupling disk 35. The cooling channels 16 of the coaxial guide rolls *2c, 2d, 3c, 3d* are connected with one another by tubular sections or elements 39, 40 mounted in a not particularly referenced throughpass bore of the coupling disk 35. These tubular sections or elements 39 and 40 are sealingly inserted into the cooling channels 16. Between the tubular sections or elements 39 and 40 the coupling disk 35 is enlarged for cooling purposes by a ring-shaped or annular groove 41.

The outer diameter of the coupling disk 35 is equal to the outer diameters of the neighbouring guide rolls *2c, 2d* and *3c, 3d.* Consequently, the cast strand is supported between the bearings 9, 10 by the coupling disk 35, so that the unsupported strand region is limited to the width of a bearing 9 and 10, as the case may be.

For sealing purposes the coupling disk 35 is provided at each side or face with a ring-shaped groove 42 into which engages a respective bearing ring 43.

While there are shown and described present preferred embodiments of the invention, it is to be distinctly understood that the invention is not limited thereto, but may be otherwise variously embodied and practiced within the scope of the following claims. Accordingly,

What we claim is:

1. In a continuous slab casting installation comprising a continuous casting mold, an arrangement of coaxially neighboring, mutually independently supported slab strand guide rolls following said continuous casting mold and serving for supporting and guiding a cast steel strand slab with still liquid core moving in a predetermined direction of travel, and slab withdrawal rolls arranged after said slab strand guide rolls, the improvement of said arrangement of said slab strand guide rolls which comprises:

at least two non-driven cooled slab strand guide rolls for guiding and supporting a common cast strand slab and arranged substantially coaxially with respect to one another at the region of the path of travel of the continuously cast slab strand for guiding and supporting by means of each one of said at least two non-driven cooled slab strand guide rolls a fraction of the width of the cast slab strand and for counteracting the ferrostatic pressure in the cast slab strand;

each of said two slab strand guide rolls having bearing journals;

a coupling means for interconnecting two neighboring ones of said bearing journals of said two slab strand guide rolls with one another in order to positively rotatably entrain both of said two slab strand guide rolls so as to safeguard against any one of said two slab strand guide rolls from failing to rotate during throughpassage of the cast slab strand and to prevent resultant damage to any such non-rotating slab strand guide roll;

said coupling means being mountable upon said two neighboring bearing journals;

said coupling means being provided with at least one entrainment surface coacting with said bearing journals for rotatably entraining said two slab strand guide rolls; and said coupling means further including flow communicating means for communicating flow of cooling medium from one slab strand roll to the neighboring slab strand roll.

2. In a continuous slab casting installation comprising a continuous casting mold, an arrangement of coaxially neighboring, mutually independently supported strand guide rolls following said continuous casting mold and serving for supporting and guiding a cast steel strand slab with still liquid core moving in a predetermined direction of travel, and slab withdrawal rolls arranged after said slab strand guide rolls, the improvement of said arrangement of said slab strand guide rolls which comprises:

at least two non-driven cooled strand guide rolls for guiding and supporting a common cast strand and arranged substantially coaxially with respect to one another at the region of the path of travel of the continuously cast strand for guiding and supporting by means of each one of said at least two cooled strand guide rolls a fraction of the width of the cast strand and for counteracting the ferrostatic pressure in the cast strand;

each of said two strand guide rolls having bearing journals;

a coupling means for interconnecting two neighboring ones of said bearing journals of said two strand guide rolls with one another in order to positively rotatably entrain both of said two strand guide rolls so as to safeguard against any one of said two strand guide rolls from failing to rotate during throughpassage of the cast strand and to prevent resultant damage to any such non-rotating strand guide roll;

said coupling means being mountable upon said two neighboring bearing journals;

said coupling means being provided with at least one entrainment surface coacting with said bearing journals for rotatably entraining said two guide rolls; and said coupling means further including flow communicating means for communicating flow of a cooling medium from one roll to the neighboring roll.

3. The arrangement as defined in claim 2, wherein:

said coupling means comprises a coupling disk having opposite faces; and the opposite faces of said coupling disk being provided with the entrainment surfaces.

4. The arrangement as defined in claim 3, wherein:

said non-driven guide rolls being provided with substantially flat entrainment means;

said coupling disk being constructed as an Oldham coupling and being provided at both faces with a respective slot;

said slots extending substantially at right angles to one another; and said coupling disk having an outer diameter which is greater than the diameter of the bearing journals of the guide rolls.

5. The arrangement as defined in claim 3, wherein:

the neighboring bearing journals of said non-driven guide rolls are provided with four-cornered journals; and recess means provided at each face of said coupling disk for coacting with a related one of said four-cornered journals.

6. The arrangement as defined in claim 2, wherein:

said coupling means has the same external diameter as related ones of said coaxially neighboring non-driven guide rolls for partly counteracting the ferrostatic pressure of the liquid core of said slab strand.

7. The arrangement as defined in claim 6, further including:

means for infeeding a cooling agent to said non-driven guide rolls; and said flow communicating means being enlarged in said coupling means to form a ring-shaped groove for cooling the surface of the coupling means which is in direct contact with the cast slab.

8. The arrangement as defined in claim 2, further including:

drive means provided for one of said neighboring non-driven guide rolls.

9. The arrangement as defined in claim 2, wherein:

said flow communicating means are additionally provided at said neighboring bearing journals of said non-driven guide rolls.

10. The arrangement as defined in claim 2, further including:

additional guide rolls following said two non-driven guide rolls in the direction of travel of said slab strand;

bearing journals and coupling means provided for each of said additional guide rolls; and said bearing journals and coupling means for said two non-driven guide rolls being offset in the axial direction of the non-driven guide rolls with respect to said bearing journals and coupling means for the following additional guide rolls.

11. The arrangement as defined in claim 2, wherein:

each non-driven said guide roll defines a roll guide surface for guiding a slab strand; and said coupling means are arranged in close proximity to said slab strand guide surfaces of said non-driven guide rolls which are intercoupled by said coupling means in order to minimize the region where said slab strand is not supported.

* * * * *